US005090206A

United States Patent [19]

Strasser

[11] Patent Number: 5,090,206

[45] Date of Patent: Feb. 25, 1992

[54] VIBRATION-DAMPENING ARRANGEMENT FOR A REFRIGERATOR OPERATING ACCORDING TO THE GIFFORD-MCMAHON PRINCIPLE

[75] Inventor: Wilhelm Strasser, Bergisch-Gladbach, Fed. Rep. of Germany

[73] Assignee: Leybold AG, Hanau, Fed. Rep. of Germany

[21] Appl. No.: 641,308

[22] Filed: Jan. 14, 1991

[30] Foreign Application Priority Data

Jan. 18, 1990 [EP] European Pat. Off. ..... 90101004

[51] Int. Cl.[5] ..... F25B 9/00

[52] U.S. Cl. ..... 62/6; 60/520

[58] Field of Search ..... 62/6; 60/520

[56] References Cited

U.S. PATENT DOCUMENTS 4,352,643 10/1982 Iijima ..... 62/297
4,642,995 2/1987 Bächler et al. ..... 62/6
4,761,963 8/1988 Kiese ..... 62/6
4,912,932 4/1990 Malaker et al. ..... 62/6
4,922,722 5/1990 Kazumoto et al. ..... 62/6
4,954,053 9/1990 Inoda et al. ..... 62/6

*Primary Examiner*—Ronald C. Capossela
*Attorney, Agent, or Firm*—Spencer & Frank

[57] ABSTRACT

A refrigerator operating on the Gifford-McMahon principle includes a housing defining a work chamber; a displacement member received in the housing and being movable back and forth between two dead center positions; a regenerator mounted in the displacement member; a piston attached to and extending from the displacement member; a drive cylinder disposed in the housing and being arranged for slidably receiving the piston; an arrangement for introducing a low-pressure working gas and a high-pressure working gas into the drive cylinder and the work chamber for reciprocating the displacement member between its dead center positions; a device for exerting a continuous force on the displacement meber in one of the directions of its reciprocation; and a throttle-containing conduit communicating with the drive cylinder for continuously maintaining either the low-pressure gas or the high-pressure gas in the drive cylinder dependent upon the direction in which the continuous force is oriented.

16 Claims, 4 Drawing Sheets

P
HD
ND
II
III
I
IV
V
OT
UT

I/II

III

IV

I
1
2
3
4
5
6
7
8
HD
ND

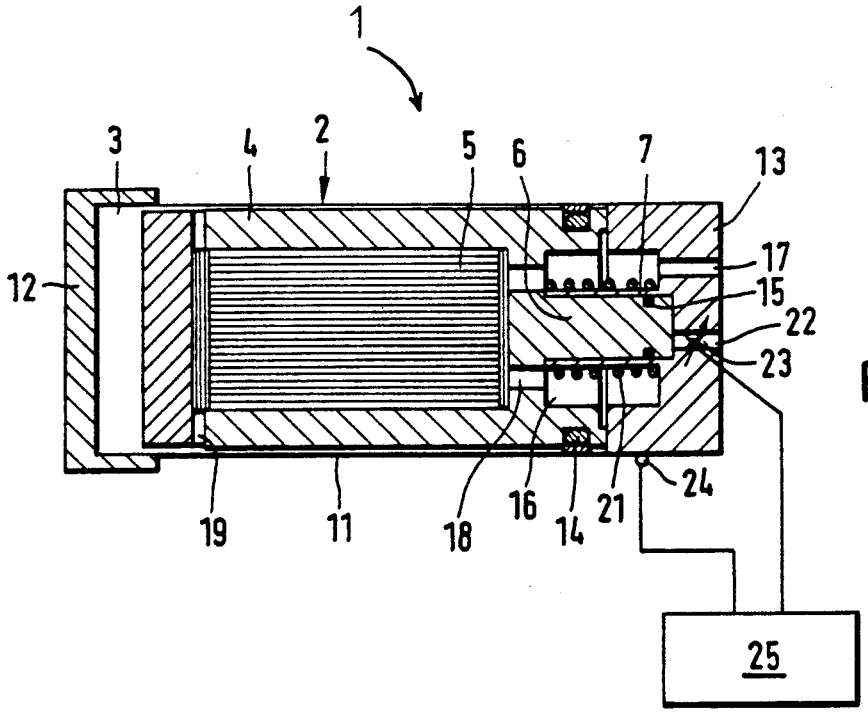
FIG.2
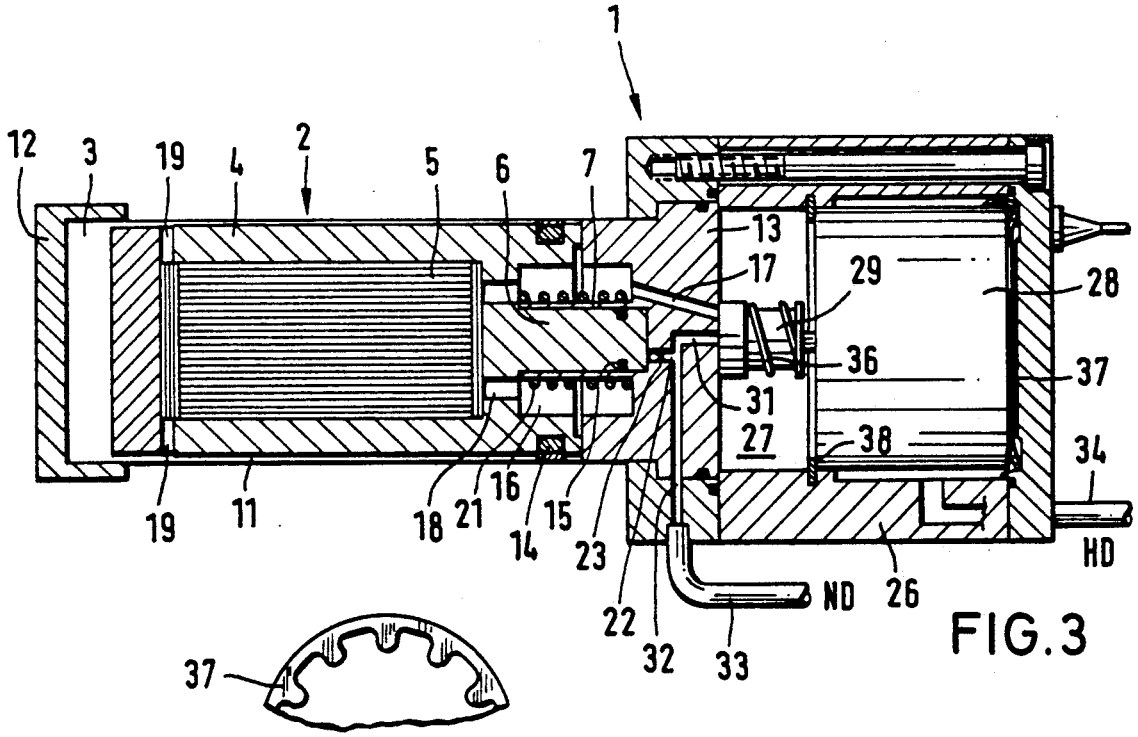
FIG.3
FIG.4

VIBRATION-DAMPENING ARRANGEMENT FOR A REFRIGERATOR OPERATING ACCORDING TO THE GIFFORD-MCMAHON PRINCIPLE

CROSS REFERENCE TO RELATED APPLICATION

This application claims the priority of European Application No. 90101004.1 filed Jan. 18th, 1990, which is incorporated herein by reference.

BACKGROUND OF THE INVENTION

The present invention relates to a refrigerator operating according to the Gifford-McMahon principle. Refrigerators are low temperature cooling machines in which a thermodynamic cycle takes place. The refrigerator includes a cylindrical work chamber disposed in a housing and further includes a displacement member which has a central regenerator and which, during operation, moves back and forth in the work chamber between two dead centers. The refrigerator further has connecting devices for a working gas including a port for a working gas at low pressure and a port for a working gas at high pressure, as well as gas control devices. A piston is fastened to the end face of the displacement member and has a smaller diameter than the displacement member. The piston cooperates with a cylinder into which merges a conduit for supplying working gas to the cylinder.

Refrigerators of the above-outlined type are used as the cold source in cryostats, cryopumps and the like.

The reciprocating movement of the displacement member generates dynamic forces, acceleration forces, inertia forces and the like which reach their maxima at the reversal points. These forces are transferred to the refrigerator housing and thus to devices coupled therewith. If the devices are sensitive to shocks, refrigerators of this type can often not be used.

It has already been proposed to damp the undesirable shocks and vibrations derived from the reciprocation of the displacement member. European Patent No. 19,426, to which corresponds U.S. Pat. No. 4,352,643, discloses the placement of a relatively expensive damping device between a cryopump and a shock sensitive instrument (for example, an electron microscope). European Patent Application No. 160,808, to which corresponds U.S. Pat. No. 4,642,995, discloses the placement of a flat spring within the work chamber. Such a spring, however, takes up a significant volume within the work chamber. This volume constitutes a dead space which reduces the efficiency of the refrigerator.

SUMMARY OF THE INVENTION

It is an object of the present invention to provide an improved refrigerator of the above-outlined type, in which the undesirable vibrations and shocks generated by the movement of the displacement member are reduced to the greatest extent possible.

This object and others to become apparent as the specification progresses, are accomplished by the invention, according to which, briefly stated, the refrigerator operating on the Gifford-McMahon principle includes a housing defining a work chamber; a displacement member received in the housing and being movable back and forth between two dead center positions; a regenerator mounted in the displacement member; a piston attached to and extending from the displacement member; a drive cylinder disposed in the housing and being arranged for slidably receiving the piston; an arrangement for introducing a low-pressure working gas and a high-pressure working gas into the drive cylinder and the work chamber for reciprocating the displacement member between its dead center positions; a device for exerting a continuous force on the displacement member in one of the directions of its reciprocation; and a throttle-containing conduit communicating with the drive cylinder for continuously maintaining either the low-pressure gas or the high-pressure gas in the drive cylinder dependent upon the direction in which the continuous force is oriented.

In a refrigerator according to the invention, the movement of the displacement member is damped in a dynamic manner. The fact that the working gas flows out of the drive cylinder and enters thereinto (depending on the direction of the constantly acting force) with a delay caused by a throttle, has a damping effect in both directions, so that the shocks involved with the reversal of the displacement member movement in both dead centers are greatly reduced. In addition, in the course of motion opposing the continuously acting force, a damping is effected by such force. Moreover, the invention has the advantage that it permits a simple construction requiring few seals and parts subject to wear so that maintenance costs are low.

BRIEF DESCRIPTION OF THE DRAWING

FIGS. 2 and 3 are sectional side elevational views of two preferred embodiments.

FIG. 4 is a fragmentary end view of a component of the embodiment of FIG. 3.

Figures 1A, 1B, 1C, 1D, 1E:
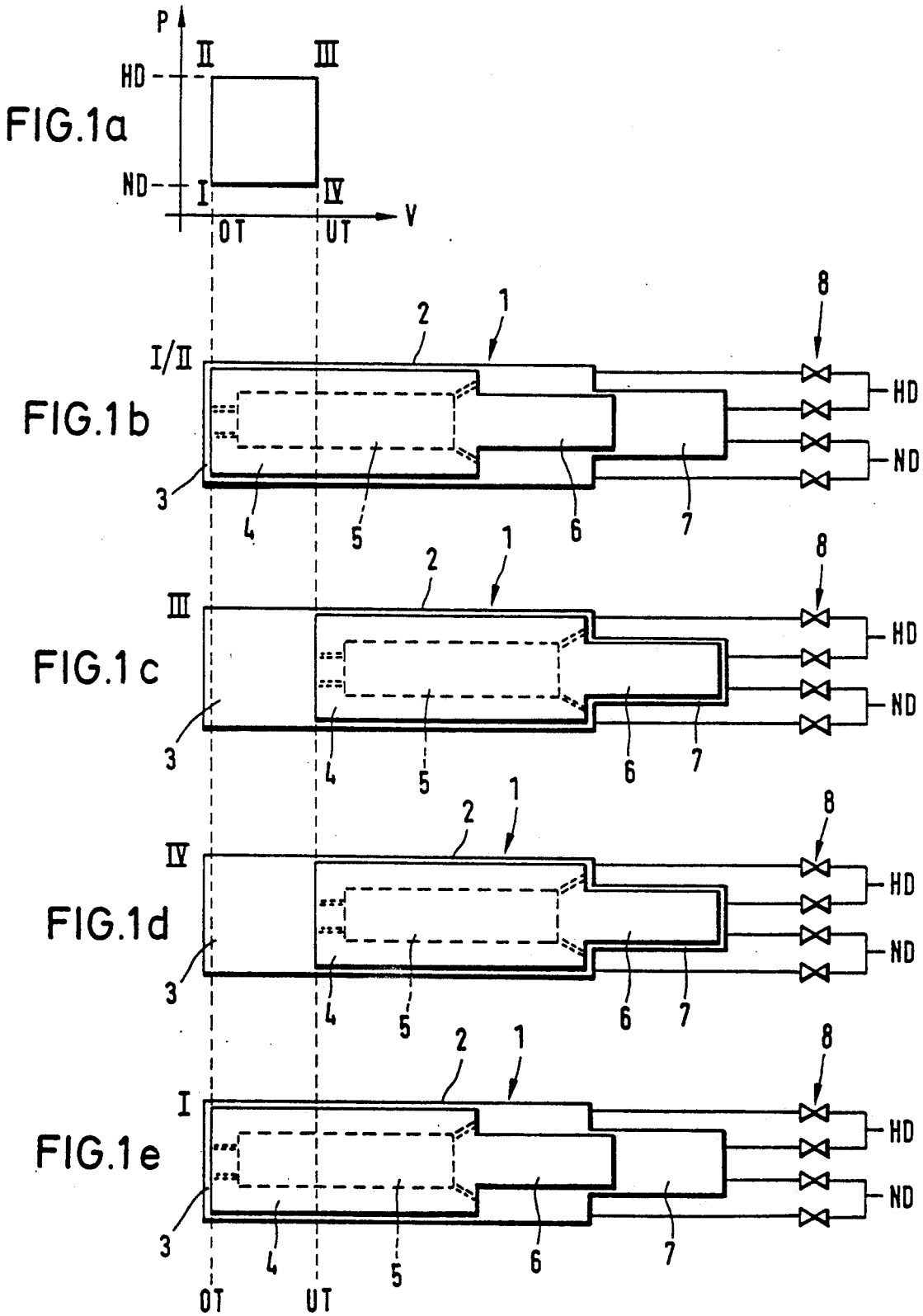
FIG. 1*a* is a diagram illustrating the stages of a process cycle of a refrigerator adapted to incorporate the invention.
FIGS. 1*b* to 1*e* are schematic views of a refrigerator depicted in different positions during an operational cycle.

DESCRIPTION OF A CONVENTIONAL THERMODYNAMIC CYCLE OF A REFRIGERATOR ADAPTED TO INCORPORATE THE INVENTION

The thermodynamic cycle of a refrigerator to be improved by the invention will now be described with reference to FIGS. 1*a* to 1*e*.

In FIGS. 1*b* to 1*e* there is shown a single-stage refrigerator 1 including a housing 2 and a cylindrical work chamber 3 receiving a displacement member 4 and a central regenerator 5. During operation, the displacement member 4 moves back and forth between the two dead centers OT and UT which represent two points on the abscissa of the graph illustrated in FIG. 1*a*.

The refrigerator has a gas drive as disclosed, for example, in European Patent Application 254,759, to which corresponds U.S. Pat. No. 4,761,963. A drive piston 6 is provided at one end face of the displacement member 4. The drive piston 6 which has a smaller diameter than the displacement member 4 is receivable in a drive cylinder 7.

In order to operate the refrigerator 1, a working gas—preferably helium—is required which is present at high pressure HD (for example, 22 bar) and at low pressure ND (for example, 7 bar). The working gas also serves to supply the gas drive. A gas distributor valve system 8 supplies the work chamber 3 and the drive cylinder 7 with the working gas. It is feasible to provide other gas supply control devices; for example, a motor driven rotary valve as disclosed in U.S. Pat. No. 4,761,963 may be used.

In FIG. 1*a*, at point I, the displacement member is at the upper dead center as indicated in FIG. 1*b*. The working gas present in the work chamber 3 is at the low pressure ND; at the same time, the drive cylinder 7 of the drive piston 6 is at the high pressure HD. In this position of the displacement member 4, the work chamber 3 is connected with the high-pressure port for the working gas. Thus the working gas pressure increases in the work chamber 3 so that point II in the diagram of FIG. 1*a* is reached. The position of the displacement member 4 remains unchanged during this time.

In order to reach point III of the diagram, the displacement member 4 is moved from the upper dead center OT to the lower dead center UT by means of the gas drive 6, 7, 8 in that the pressure in the drive cylinder 7 is changed from the high pressure HD to the low pressure ND, whereupon the displacement member 4 assumes the position shown in FIG. 1*c*.

During the two last-described phases, working gas flows through the regenerator 5 in the direction toward the upper dead center and thus cools off, since the regenerator 5 has a low temperature due to the previous movements of the displacement member 4.

While the displacement member 4 is at the lower dead center (FIG. 1*d*), the pressure in the work chamber 3 is changed from high pressure to low pressure, whereby the working gas expands and cools. The cooled working gas flows through the regenerator 5 in the opposite direction and cools it further. In the diagram of FIG. 1*a* this phase corresponds to the transition from point III to point IV.

As the last step in the cycle, the displacement member 4 is moved back into the upper dead center by virtue of having charged the drive cylinder 7 with high pressure. FIG. 1*e* shows the displacement member 4 back in its starting position as in FIG. 1*b*.

During the reciprocation of the displacement member 4, heat is continuously removed from the housing 2 in the region of the upper dead center. Single-stage refrigerators of this type are able to produce temperatures down to about 30 K., Refrigerators are often two-stage structures as disclosed in the above-cited U.S. Pat. No. 4,761,963. Two-stage refrigerators are able to produce temperatures to below 10 K.

DESCRIPTION OF THE PREFERRED EMBODIMENTS OF THE INVENTION

In each embodiment shown in FIGS. 2 to 8 the housing 2 of the refrigerator 1 is composed of a cylindrical section 11, a cap 12 (at the "cold" end) and a cylindrical intermediate piece 13 (at the "warm" end). Due to the provision of a seal 14, a reliable separation of the "cold" side of a displacement member 4 from its "warm" side is ensured. A piston 6, also provided with a seal 15 and disposed on the "warm" side of the displacement member, is guided in a drive cylinder 7 which is a component of the intermediate piece 13. The cylinder 7 is surrounded by an annular chamber 16 which is formed by corresponding recesses in the displacement member 4 and in the intermediate piece 13. A bore 17 through which the work chamber 3 is supplied with working gas is provided in an end of the intermediate member 13 and opens into the annular chamber 16. Within the displacement member, bores 18 are provided which extend into the annular chamber 16 and through which the working gas flows into or out of the regenerator 5. Lateral bores 19 and a reduced diameter of the "cold" end of the displacement member 4 form the flow paths for the working gas between the regenerator 5 and the work chamber 3.

Figure 8:
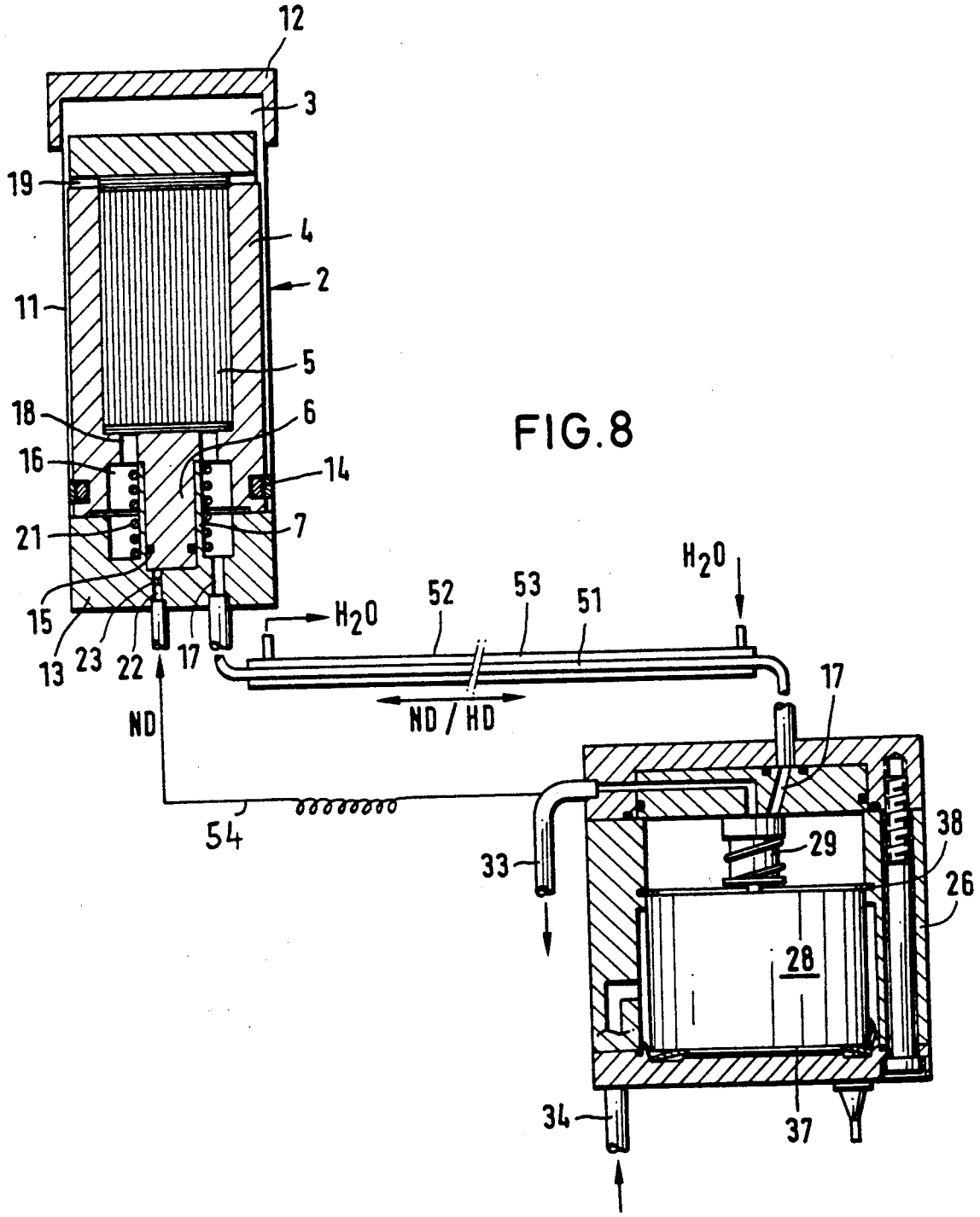

In the embodiments according to FIGS. 2, 3 and 8, a coil spring 21 surrounding the cylinder 7 is disposed within the annular chamber 16 and abuts the displacement member 4 and the intermediate piece 13 to exert a continuous force which seeks to move the displacement member 4 toward its "cold" end. The dimensions of the spring 21 are such that a shift of the displacement member 4 in the direction of the warm side may readily take place. Before the piston 6 reaches the dead center, however, the spring 21 damps the movement, supported by the gas damping, so that shocks having an external effect are avoided.

A bore 22 passes through the intermediate piece 13 and opens into the cylinder 7 for supplying the cylinder 7 with working gas. The bore 22 contains a choke or throttle 23 which serves to damp the movement of displacement member 4. In the embodiments of FIGS. 2, 3, 5, 6 and 8, during movement of the displacement member 4 in the direction of its cold end the supply of the cylinder 7 with working gas is controlled by connecting the bore 22 with the low-pressure port. The movement of the displacement member 4, initially supported by the spring 21, is, before the piston 6 reaches the dead center, damped by the fact that the working gas can flow through the choke 23 into the drive cylinder 7 only at a limited rate. The flow passage of the choke 23 must be set so that an effective damping is obtained.

In the embodiment according to FIG. 2, an arrow symbolizes the adjustability of the choke 23. In addition, an acceleration sensor 24, fastened to the refrigerator housing, furnishes a signal, representing motion characteristics of the displacement member 4, to a control unit 25 with which the choke 23 is adjusted automatically. With such a device an optimum damping may be obtained independently of the operating state.

FIG. 3 shows the manner in which the gas is supplied. A housing 26 which has an inner housing space 27 and which is fastened to the intermediate piece 13, accommodates a drive motor 28 and a rotary valve 29. A bore 17 and—centrally—a further bore 31 open into the region in which the rotary valve 29 lies on the end face of the intermediate piece 13. The bore 31 and the bore 22 containing the choke 23 are in communication with a transverse bore 32 which is connected to a low-pressure port 33. A high-pressure port 34 opens into the interior 27 of the housing 26. The rotary valve 29 has such a configuration that the bore 17 is alternatingly supplied with working gas at high pressure and with working gas at low pressure.

A tight contact between the rotary valve 29 and the intermediate piece 13 is ensured by a spring 36 urging the rotary valve 29 against the end face of the intermediate piece 13. The drive motor 28 is positioned in the housing 26 either with the aid of a metal pressure spring 37 (FIG. 4) and a clamping ring 38 or with the aid of a rubber elastic spring ring 41 and a clamping ring 42 (FIG. 7).

As already described, the element exerting a continuous force on the displacement member 4 in FIGS. 2, 3 and 8 is a compression spring 21 which urges the displacement member 4 toward its "cold" end. In case of a compression spring, the bore 22 and the choke 23 are connected with the low-pressure port 33. It is also feasible to employ a tension spring instead of the compression spring 21. In such a case, the bore 22 and the choke 23 must be connected with the high-pressure port 34.

Figure 5:
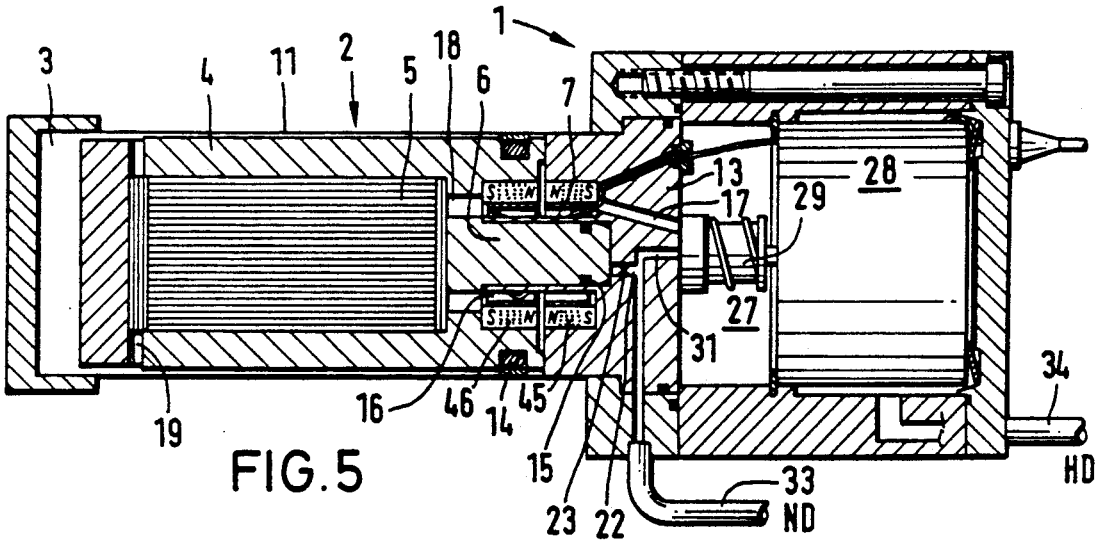
FIGS. 5 to 8 are sectional side elevational views of four further preferred embodiments.
Figure 6:
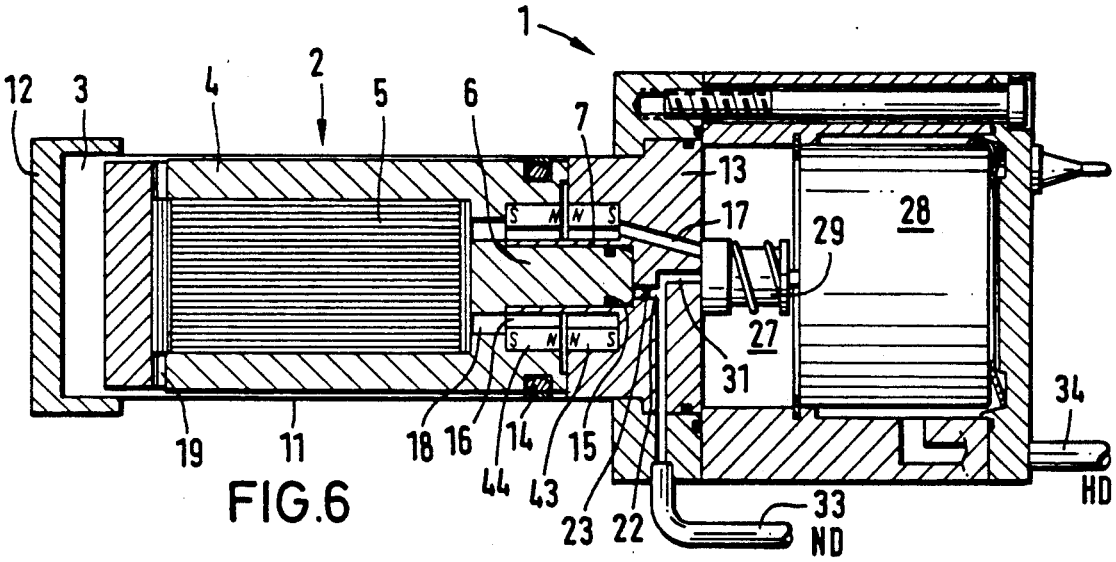

In the embodiments according to FIGS. 5 and 6, the force acting continuously on the displacement member 4 is magnetic. For this purpose, the intermediate piece 13 and the displacement member 4 are provided with permanent magnets 43, 44 (FIG. 6) or electromagnets 45, 46 (FIG. 5). In the illustrated embodiments, the polarity has been selected in such a manner that the magnets repel one another and thus the force continuously acting on the displacement member 4 urges the displacement member 4 toward its "cold" end. The bore 22 and the choke 23 are therefore again connected with the low-pressure port 33. For the case that the polarity of the magnets is selected such that they attract one another, the force would act in the opposite direction, in which case then the bore 22 would be in communication with the high-pressure port 34.

Figure 7:
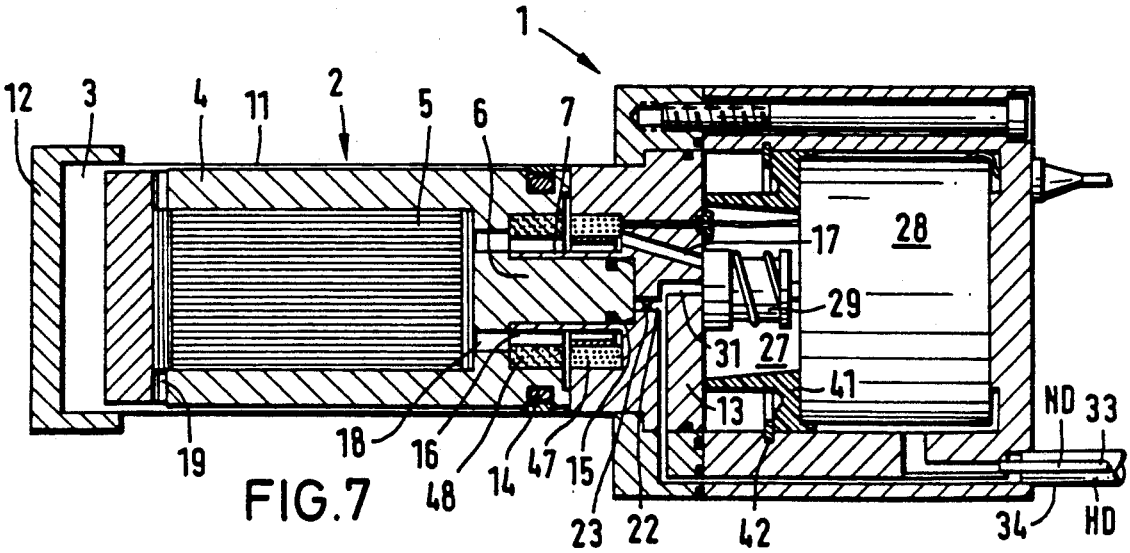

In the embodiment according to FIG. 7, the intermediate piece 13 is provided with a solenoid 47 which cooperates with a soft-iron ring 48 secured to the displacement member 4. In this embodiment, the soft-iron ring 48 is attracted if the solenoid 47 is energized, so that the bore 22 must be connected with the high-pressure port 34.

In the embodiment according to FIG. 8 the refrigerator 1 is formed of separated components. The components accommodated in housing 2 and those contained in housing 26 are connected with one another by means of a conduit 51 which can be considered as forming an extension of the bore 17 in the intermediate piece 13. In the relatively large volume of the conduit 51, the working gas merely flows back and forth and thus no complete exchange takes place. It is therefore advisable to cool the connecting conduit 51 which, for this purpose, is coaxially surrounded by a pipe conduit 52. A coolant, preferably cooling water, flows through the annular chamber 53 of the conduit 52.

In order to connect the bore 22 with the low-pressure gas port 33, it is sufficient for the bore to be formed of a capillary 54. It must merely be ensured that a low pressure exists in the region of the bore 22 and thus an appreciable gas flow is not needed.

It will be understood that the above description of the present invention is susceptible to various modifications, changes and adaptations, and the same are intended to be comprehended within the meaning and range of equivalents of the appended claims.

What is claimed is:

1. In a refrigerator operating on the Gifford-McMahon principle, including a housing defining a work chamber;

a displacement member received in said housing and being movable back and forth between two dead center positions; said displacement member having an outer diameter, a first end bounding said work chamber and an opposite, second end oriented away from said work chamber;

a regenerator mounted in said displacement member;

a piston attached to and extending from said second end; said piston having an outer diameter smaller than the outer diameter of said displacement member;

a drive cylinder disposed in said housing and being arranged for slidably receiving said piston; and first means for introducing a low-pressure working gas and a high-pressure working gas into said drive cylinder and said work chamber for reciprocating said displacement member between said dead center positions;

the improvement comprising (a) second means for exerting a continuous force on said displacement member in a direction of one of the first and second ends thereof;

(b) a conduit, forming part of said first means, communicating with said drive cylinder for continuously maintaining one of said low-pressure gas and said high-pressure gas in said drive cylinder dependent upon the direction of said continuous force; and (c) a throttle contained in said conduit.

2. A refrigerator as defined in claim 1, wherein said second means comprises a first electromagnet held stationarily in said housing and a second electromagnet mounted on said displacement member; said first and second electromagnets cooperating with one another for generating said continuous force.

3. A refrigerator as defined in claim 1, wherein said second means comprises a first permanent magnet held stationarily in said housing and a second permanent magnet mounted on said displacement member; said first and second permanent magnets cooperating with one another for generating said continuous force.

4. A refrigerator as defined in claim 1, wherein said second means comprises an electromagnet held stationarily in said housing and a soft-iron core mounted on said displacement member; said electromagnet and said soft-iron core cooperating with one another for generating said continuous force.

5. A refrigerator as defined in claim 1, further comprising means for adjusting said throttle.

6. A refrigerator as defined in claim 1, wherein said throttle is adjustable; further comprising a control device connected to said throttle and a sensor means for sensing a magnitude of acceleration of said displacement member and being connected to said control device for regulating the throttle by the control device as a function of said magnitude of acceleration.

7. A refrigerator as defined in claim 1, wherein said housing is a first housing and said conduit is a first conduit; further comprising (d) a second housing accommodating one part of said first means; said second housing being a structural unit separate and physically spaced from said first housing;

(e) a second conduit, forming part of said first means, connecting said first housing with said second housing; and (f) means for cooling said second conduit.

8. A refrigerator as defined in claim 1, wherein said direction is oriented towards said first end and wherein one of the low-pressure gas and high-pressure gas is said low-pressure gas.

9. A refrigerator as defined in claim 8, wherein said second means comprises a compression spring exerting said continuous force on said displacement member.

10. A refrigerator as defined in claim 1, wherein said direction is oriented towards said second end and wherein one of the low-pressure gas and high-pressure gas is said high-pressure gas.

11. A refrigerator as defined in claim 10, wherein said second means comprises a tension spring exerting said continuous force on said displacement member.

12. A refrigerator as defined in claim 1, wherein said second means comprises a spring exerting said continuous force on said displacement member.

13. A refrigerator as defined in claim 12, wherein said spring is a coil spring surrounding said drive cylinder and having an end being in engagement with said second end of said displacement member.

14. A refrigerator as defined in claim 1, wherein said housing comprises (a) a cylindrical length portion accommodating said displacement member;

(b) a terminal cap attached to said cylindrical length portion and defining said work chamber; and (c) an intermediate piece attached to said cylindrical length portion and defining said drive cylinder.

15. A refrigerator as defined in claim 14, further comprising an annular chamber surrounding said drive cylinder; said second means being accommodated in said annular chamber.

16. A refrigerator as defined in claim 15, wherein said conduit is a first conduit; said first means further comprising a second conduit maintaining communication between said regenerator and said annular chamber; and a third conduit communicating with said annular chamber and extending through said housing.

* * * * *